US011416014B2

(12) United States Patent
Kadanka

(10) Patent No.: US 11,416,014 B2
(45) Date of Patent: Aug. 16, 2022

(54) TRIGGERED SINK CIRCUIT FOR A LINEAR REGULATOR

(71) Applicant: SEMICONDUCTOR COMPONENTS INDUSTRIES, LLC, Phoenix, AZ (US)

(72) Inventor: Petr Kadanka, Valasska Bystrice (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 186 days.

(21) Appl. No.: 16/799,205

(22) Filed: Feb. 24, 2020

(65) Prior Publication Data

US 2021/0263544 A1 Aug. 26, 2021

(51) Int. Cl.
*G05F 1/575* (2006.01)
*G05F 1/613* (2006.01)

(52) U.S. Cl.
CPC ..... *G05F 1/575* (2013.01); *G05F 1/613* (2013.01)

(58) Field of Classification Search
CPC . G05F 1/46; G05F 1/462; G05F 1/468; G05F 1/54; G05F 1/56; G05F 1/561; G05F 1/562; G05F 1/565; G05F 1/569; G05F 1/571; G05F 1/573; G05F 1/5735; G05F 1/575; G05F 1/613
See application file for complete search history.

(56) References Cited

U.S. PATENT DOCUMENTS 8,040,118 B2 * 10/2011 Cho ..... G05F 1/565 323/273
2016/0161961 A1 * 6/2016 El-Nozahi ..... G05F 1/56 323/280
2020/0081471 A1 * 3/2020 Pini ..... G05F 1/618

OTHER PUBLICATIONS

ON Semiconductor, "MC##761 Ultra Low-Noise Low Dropout Voltage Regulator with 1.0 V ON/OFF Control," Jan. 2004, rev. 7.
Lin Cong, "Fully Integrated Regulators with Ultra-Fast Transient Response", Georgia Institute of Technology, Analog Consortium Electrical & Computer Engineering, 2002.

* cited by examiner

*Primary Examiner* — Nguyen Tran
(74) *Attorney, Agent, or Firm* — Brake Hughes Bellermann LLP

(57) ABSTRACT

A triggered sink circuit for a linear voltage regulator, such as low-dropout voltage regulator (LDO), is disclosed. The triggered sink circuit is activated only when needed to sink current from an output in response to a transient load change. The triggered sink circuit includes a large sink transistor that when activated drains current from the output of the LDO to quickly restore an output voltage back towards a regulated value, thereby improving a load transient response to the load change. The improved load transient response prevents the output transistor of the LDO from being completely deactivated to restore regulation. Accordingly, the LDO's response to a subsequent load transient can be improved.

20 Claims, 7 Drawing Sheets

TRIGGERED SINK CIRCUIT FOR A LINEAR REGULATOR

FIELD OF THE DISCLOSURE

The present disclosure relates to analog microelectronic circuits and more specifically to a linear regulator having a sink circuit that can be triggered to accommodate a particular load transient condition.

BACKGROUND

A low-dropout (LDO) regulator (i.e., LDO) is a linear voltage regulator that is configured to convert an unregulated input voltage ($V_{IN}$) to a regulated output voltage ($V_{OUT}$) by controlling the conduction level of an output transistor ($M_O$) so that a voltage drop is created between an input and an output of the LDO that responds to variations in the input voltage so that the output voltage is fixed (e.g., relative to a reference voltage, $V_{REF}$).

The LDO may respond to a changing load according to a load transient response (LOTR). For example, if a changing load causes an output current ($I_{OUT}$) to suddenly increase or decrease the output voltage ($V_{OUT}$) may deviate from its regulated level for a period while the LDO circuit responds. The LOTR describes an amplitude of the deviation and the period of response. Generally, lower amplitude deviations are more desirable than higher amplitude deviations, and shorter periods are more desirable than longer periods. It is in this context, that implementations of the disclosure arise.

SUMMARY

In at least one aspect, the present disclosure generally describes a method. The method includes regulating an output voltage using a low-dropout voltage regulator (i.e., an LDO). The method further includes detecting a particular type of load transient (e.g. a load increase) when an output voltage of the LDO satisfies a criterion (e.g., the output voltage≥a threshold voltage). Upon detecting the particular type of load transient, the method includes sinking current from an output of the LDO using a triggered sink circuit that includes a sink transistor. The sinking includes activating the sink transistor to sink current from the output of the LDO while the output voltage of the LDO satisfies the criterion, and when the output voltage does not satisfy the criterion, gradually deactivating the sink transistor.

In another aspect, the present disclosure generally describes a low-dropout voltage regulator (LDO). The LDO includes an output transistor that is configured to increase or decreased current sourced (i.e., conducted) to an output of the LDO according to a corresponding decrease or increase in an output voltage of the LDO. The LDO further includes a triggered sink circuit that is activated to sink current from the output of the LDO when the increase in the output voltage exceeds a threshold and that is gradually deactivated when the output voltage no longer exceeds the threshold.

In another aspect, the present disclosure generally describes a triggered sink circuit for a low-dropout voltage regulator (LDO). The triggered sink circuit includes a sink trigger that is coupled to an output voltage of the LDO. The sink trigger is configured to generate a trigger signal that is held at a trigger voltage during an ON-period while the output voltage of the LDO satisfies a criterion. The triggered sink circuit further includes a sink control that receives the trigger signal and generates a sink control signal in response. The sink control signal is held at an ON-voltage during the ON-period and then is gradually reduced according to a soft shutdown profile during a shutdown-period. The triggered sink circuit further includes a sink transistor that is activated (i.e., turned ON, made conducting) by the ON-voltage to sink current from an output of the LDO during the ON-period and then is gradually deactivated according to the soft shutdown profile during the shutdown period.

In a possible implementation the activated sink transistor of the triggered sink circuit reduces a load transient response of the LDO.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
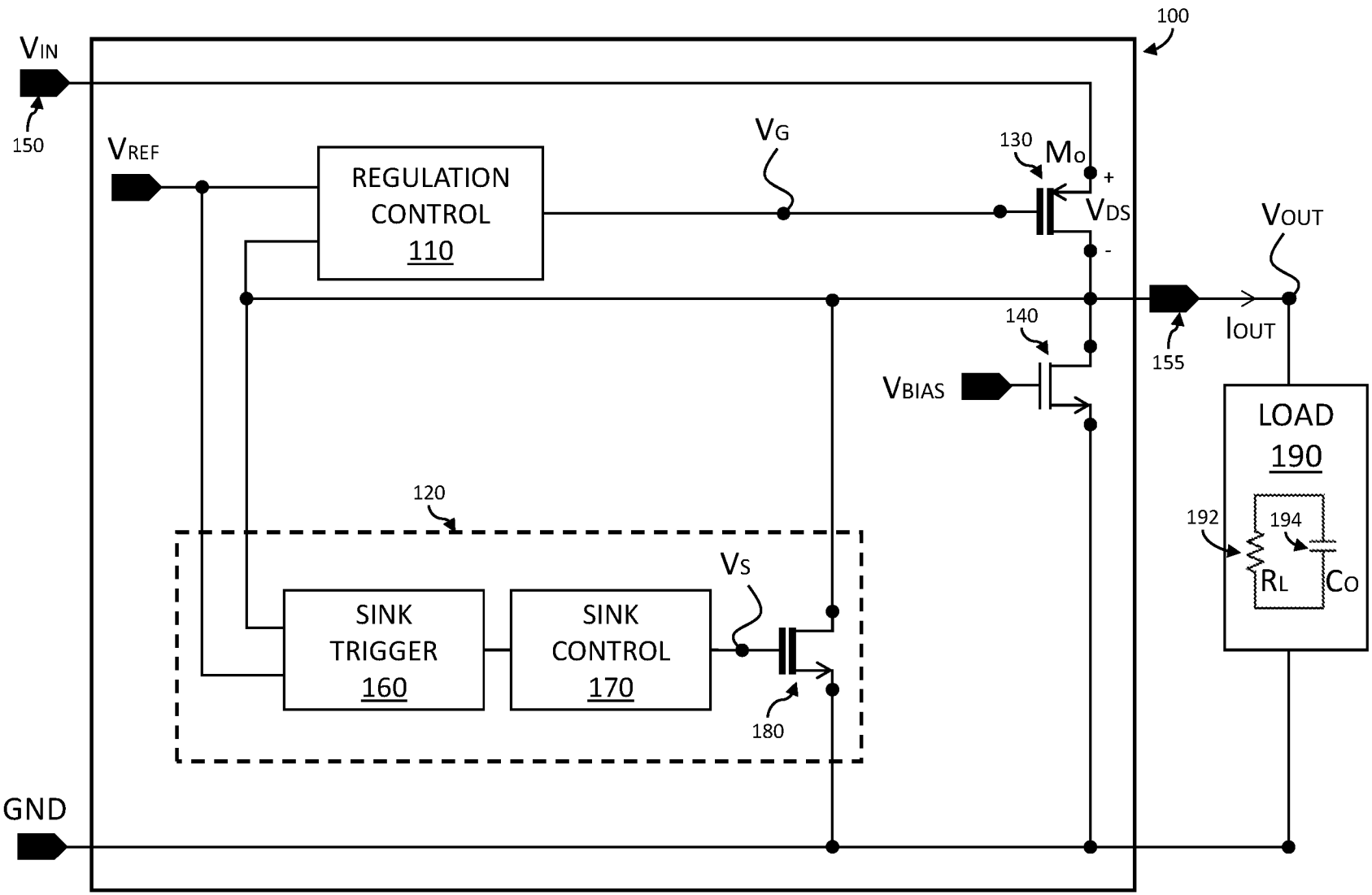
FIG. 1 is a block diagram of a low-dropout voltage regulator (i.e., LDO) including a triggered sink circuit according to a possible implementation of the present disclosure.

A linear voltage regulator (i.e., linear regulator) may be able to source a large output current to a load but may have less ability to sink the same amount of current. As a result, an output current that steps from a high value to a low value may result in a load transient response that is unacceptable. The present disclosure describes circuits and methods to respond to the load current change with additional sinking to improve the load transient response of the linear regulator. While the disclosed techniques may be applied to most linear regulators, the implementation of the low-dropout (LDO) regulator will be considered in detail.

The present disclosure describes an LDO regulator that includes a triggered sink circuit configured to respond to a type of load transient (LOT). The triggered sink circuit includes a sink transistor coupled to an output of the LDO, which can be configured to provide a high-capacity conductive path (e.g., from the output to a ground) in order to quickly sink (i.e., drain) current from a load (e.g., a capacitive load) to help reduce an elevated output voltage ($V_{OUT}$). The sink transistor is controlled by a sink-control signal ($V_S$)

to turn ON (i.e., decrease resistance) for a period in order to sink current from the load and then, after a sink period, turn OFF (i.e., increase resistance) according to a slow-release (i.e., soft shutdown) profile. The soft shutdown profile can reduce (or eliminate) a load transient response in the output voltage ($V_{OUT}$) caused by the ON/OFF switching of the sink transistor. For example, the soft shutdown profile decreases a conductivity of the sink transistor over a shutdown period according to a shutdown slope (rate) so that a load transient response generated by the soft shutdown is less than a predetermined value. In other words, the shutdown period and the shutdown rate can correspond to a load transient response less than a predetermined value.

The disclosed LDO regulator including a triggered sink circuit can advantageously reduce (e.g., as compared to an LDO regulator without a sink circuit) the period over which an elevated output voltage is reduced back to a regulated value. The reduced period can prevent the LDO from settling at a limit (i.e., rail) of its control, which can be helpful in improving the LDO's response to a subsequent load transient (i.e., back-to-back load transients). Further, the conditional triggering (i.e., activation) of the triggered sink circuit prevents the sink circuit from affecting operation of the LDO in other load conditions and therefore can be advantageously implemented with limited (or with no) impact on other portions of the LDO circuit.

A load transient (LOT) is a (fast) change in a load coupled to an output of the LDO that causes a corresponding (fast) change in an output current ($I_{OUT}$) of the LDO. For example, a load may be switched so that as a switch decouples the load from the LDO, the output current of the LDO quickly changes from a non-zero current (e.g., $I_{OUT}$>100 milliamps) to a zero current (e.g., $I_{OUT}$=0 milliamps). A load transient may be classified by its behavior.

A first type of LOT is caused by a decrease in a load resistance. The decreased load resistance ($R_L$) can cause a corresponding decrease in output voltage ($V_{OUT}$) from a regulated voltage level. In response, the LDO can be configured to increase current output to the load (i.e., to source current) in order to restore (i.e., increase) the output voltage back to the regulated voltage level.

A second type of LOT is caused by an increase in a load resistance. The increased load resistance can cause a corresponding increase in output voltage ($V_{OUT}$) from a regulated voltage level. In response, the LDO can be configured reduce current output to the load in order to reduce the output voltage back to the regulated voltage level. As summary of the load transient examples described above is shown in TABLE 1.

TABLE 1

SUMMARY OF EXAMPLE LOAD TRANSIENTS (LOT)

| | LOT: FIRST TYPE | LOT: SECOND TYPE |
|---|---|---|
| $R_L$ | ↓ DECREASE | ↑ INCREASE |
| $I_{OUT}$ | ↑ INCREASE | ↓ DECREASE |
| $V_{OUT}$ | ↓ DECREASE | ↑ INCREASE |
| LDO RESPONSE | SOURCE CURRENT | SINK CURRENT |

When the load is purely resistive an elevated output voltage can be reduced simply with a decrease in output current supplied to the load. When the load includes a reactive component (e.g., a capacitor, $C_O$), however, simply reducing the output current supplied to the load may be insufficient in reducing the output voltage. For example, to reduce output voltage on a capacitive load (e.g., such as an image sensor), the output of the LDO must be configured to sink current from the capacitive load in order to dissipate its voltage.

The faster an LDO can sink current from the capacitive load, the faster the output voltage may be reduced back to the regulated voltage level. If the LDO is limited in its capacity to sink current from the load, the output voltage ($V_{OUT}$) may be reduced slowly over a period. In other words, the output voltage ($V_{OUT}$) may persist at a value that is higher than a regulated voltage level for the period. A feedback response created by a persistently high output voltage can cause the LDO to settle (i.e., rail) at a limit of its control. In this condition, the output transistor ($M_O$) is turned completely OFF and the output voltage ($V_{OUT}$) is no longer under control. A subsequent load transient (i.e., load change) can result in a very poor LOT response as the output transistor ($M_O$) is turned back ON to restore control over the output voltage.

FIG. 1 is a block diagram of an LDO regulator including a triggered sink circuit according to a possible implementation of the present disclosure. The LDO 100 is configured to receive (at an input 150 of the LDO) an unregulated input voltage ($V_{IN}$) relative to a ground voltage (GND) and to transmit (at an output 155 of the LDO) a regulated output voltage ($V_{OUT}$) relative to the ground voltage. The output voltage is regulated by a regulation control circuit (i.e., regulation control 110). The regulation control 110 is configured to receive the output voltage ($V_{OUT}$) as feedback from the output of the LDO. The regulation control 110 is also configured to receive a reference voltage ($V_{REF}$) from circuitry included in (but not shown) the LDO. The reference voltage provides a stable voltage level to which the output voltage ($V_{OUT}$) can be compared. The regulation control 110 is configured to compare the output voltage ($V_{OUT}$) to the reference voltage ($V_{REF}$) and based on the comparison, generate a control signal ($V_G$) for an output transistor 130 ($M_O$).

The output transistor 130 (and other transistors of the LDO) may be implemented in a variety of technologies including (but not limited to) bipolar junction transistor (BJT) and field effect transistor (FET). The output transistor 130 shown in FIG. 1 is implemented as a (P-type) metal oxide semiconductor transistor (MOSFET). A controlling (e.g., gate) terminal of the output transistor 130 is configured to receive the control signal (e.g., gate voltage) from the regulation control 110. A level of the control signal ($V_G$) generates a corresponding voltage drop (e.g., $V_{DS}$) between a source terminal and a drain terminal of the output transistor 130.

As shown in FIG. 1, the input voltage ($V_{IN}$) is coupled to the source terminal of the output transistor 130 and the output terminal of the LDO is coupled to the drain terminal of the output transistor 130. Accordingly, the output voltage ($V_{OUT}$) is a difference between the input voltage ($V_{IN}$) and the voltage drop across the output transistor (i.e. $V_{DS}$). By controlling this voltage drop ($V_{DS}$), the output voltage ($V_{OUT}$) can be regulated. For example, if the input voltage ($V_{IN}$) is increased, the output voltage ($V_{OUT}$) is increased. The regulation control 110 compares the increased output voltage ($V_{OUT}$) with the reference voltage ($V_{REF}$) to generate a control signal ($V_G$) that increases the voltage drop ($V_{DS}$) across the output transistor so that the output voltage ($V_{OUT}$) is reduced back to a regulated voltage (i.e., relative to the reference voltage).

The output transistor 130 may be a power MOSFET designed (e.g., sized) to conduct relatively large currents (e.g., >100 milliamps) from the input to the output of the LDO. The output transistor 130 may be capable of conducting a leakage current at a level (especially at an elevated temperature) that can cause changes in an output voltage (e.g., in a no-load condition). To prevent this, the leakage current of the output transistor 130 can sunk to ground and does not affect the output voltage. Accordingly, the LDO can include a leakage transistor 140 that is configured to drain (i.e., sink) leakage current from the output transistor 130 ($M_O$) to prevent an unwanted output voltage increase in a low (e.g., zero) load condition.

The leakage transistor 140 may be implemented as an (N-type) MOSFET having a size that is small relative to a size of the output transistor 130. The leakage transistor 140 can be large enough to sink a level of leakage current from the output transistor 130 but small enough so that a quiescent current of the LDO is kept low. The amount of leakage current may that the leakage transistor 140 can sink may depend on a size of the output transistor (e.g., larger output transistors may have larger leakage currents) and may depend on temperature (e.g., higher temperatures may cause larger leakage currents). In one possible implementation the leakage current is small compared to the output current (e.g., <10 microamps as compared to >100 mA). Thus, the output transistor 130 may be able to source more current than the leakage transistor 140 can sink. Accordingly, the LDO may include a triggered sink circuit 120 to supplement (i.e., enhance) a sinking capability of the leakage transistor 140 for certain load (i.e., output voltage) conditions.

A load 190 may be coupled to an output of the LDO. The load 190 may include a resistive component 192 and a reactive (e.g., capacitive 194) component. A load transient (LOT) may include a change (e.g. an abrupt change) in the resistive component and/or capacitive component of the load. As described previously, the abrupt change may cause a load transient response (LOTR) in the LDO. Without the triggered sink circuit 120, the LDO may respond poorly to load transients that required sinking a large current.

Figure 2:
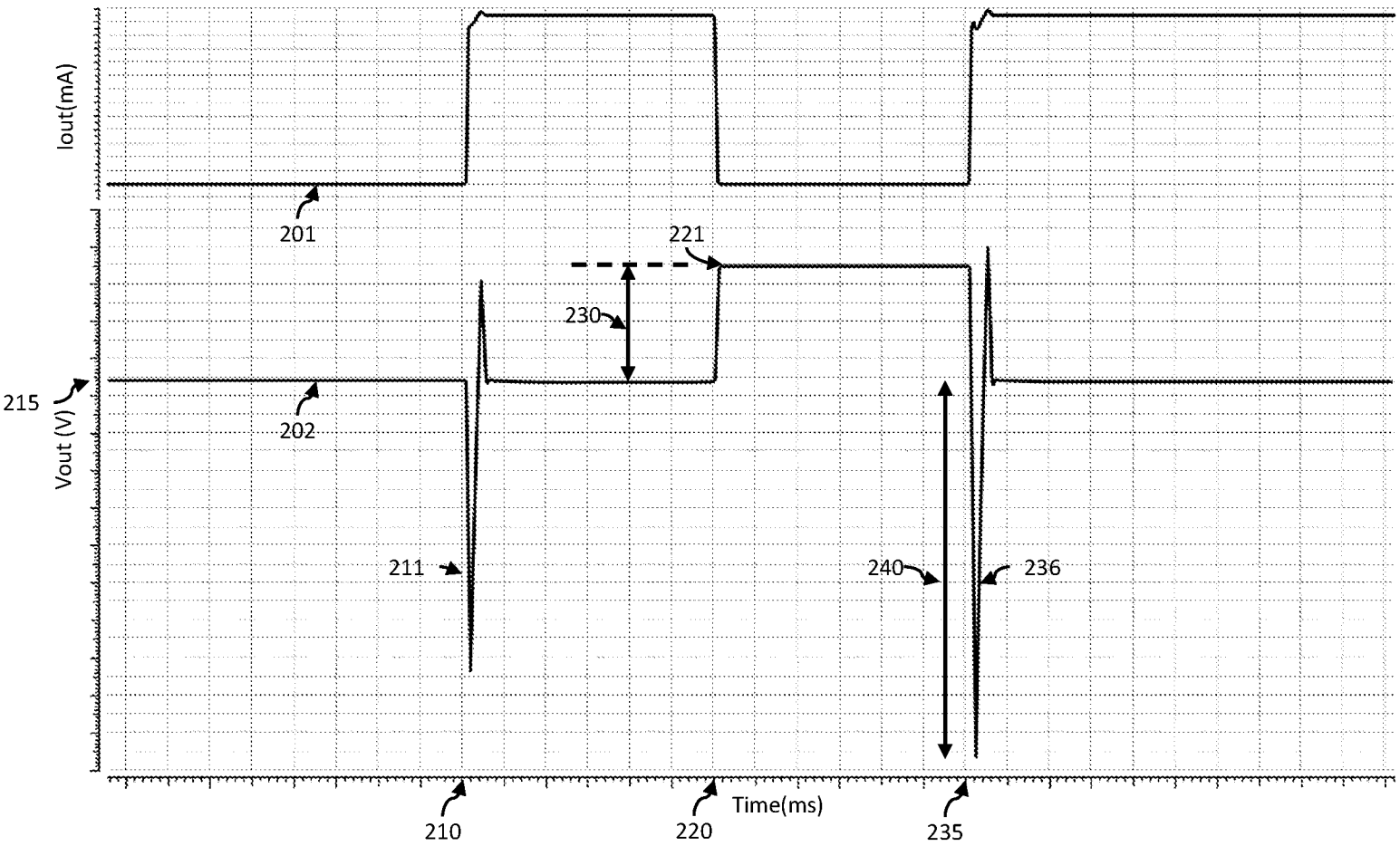
FIG. 2 includes time-based graphs illustrating an LDO's response to load transients when the triggered sink circuit is not used according to a possible implementation of the present disclosure.

FIG. 2 includes time-based graphs illustrating an LDO load transient response (LOTR) of an LDO without the triggered sink circuit. The graphs include an output current ($I_{OUT}$) graph 201 and an output voltage ($V_{OUT}$) graph 202 for load changes as described in TABLE 1.

A first load change at a first time 210 causes a first load transient response 211 (LOTR) that includes a decrease in output voltage ($V_{OUT}$). In response, the regulation control 110 configures the output transistor 130 to source current to the load 190 in order to restore (i.e., increase) the output voltage ($V_{OUT}$) to a regulated value 215. Because the output transistor can source a large current, regulation is quickly restored (i.e., restored before a subsequent load transient).

A second load change at a second time 220 causes a second load transient 221 that includes an increase in the output voltage ($V_{OUT}$). In response, the LDO 100 is configured to sink current from the load in order to restore (i.e., decrease) the output voltage ($V_{OUT}$) to the regulated value 215 (i.e., regulated voltage). Without the triggered sink circuit 120, however, the LDO relies on the leakage transistor to sink the current from the load. Because the leakage transistor is small, the current is drained (i.e., sinks) slowly and the second load transient response decreases at a very low rate. In this condition, the output voltage remains (i.e., persists) above the regulated value 215 at an amplitude 230 above the regulated value 215. As the output voltage persists above the regulated value 215, the regulation control may turn the output transistor 130 OFF so that it no longer conducts (i.e., drops any voltage between the input and the output). In other words, in this condition the output of the LDO can be become unregulated.

A third load change at a third time 235 causes a third load transient response 236 that includes a decrease in the output voltage ($V_{OUT}$). The third load change occurs before the LDO has recovered from the second load change. Accordingly, the third load transient response 236 may have a much larger amplitude 240 than the first load transient response 211. This increase in amplitude can be due, at least in part, because the (large) output transistor 130 was turned OFF as a result of the second load change and must be turned ON again to begin regulation.

The changes in current resulting from the load changes may have amplitudes that are multiple orders of magnitude. For example, the output current shown the $I_{OUT}$ graph 201 may change from approximately 1 microamp (μA) to approximately 250 milliamps (mA) for a load change.

Returning to FIG. 1, the LDO 100 includes a triggered sink circuit 120 to help sink current from the load in response to a load transient (see TABLE 1). The triggered sink circuit 120 includes a sink trigger circuit (i.e., sink trigger 160) that is configured to generate a trigger signal to activate a sink control circuit (i.e., sink control 170) when a load change (i.e., load transient) meets (e.g., satisfies) a sink criterion (i.e., criterion). For example, the sink trigger 160 may be configured to compare the output voltage ($V_{OUT}$) to a threshold and if the output voltage exceeds a threshold level then the sink trigger may activate (i.e., trigger) the sink control 170. Once activated, the sink control 170 is configured to generate a sink control signal ($V_S$) to control a sink transistor 180 to conduct current (i.e., sink current) from the LDO output to ground. The sink transistor 180 may be a FET (e.g., N-type power MOSFET) that is a size capable of conducting a larger amount of current than the leakage transistor 140. In a possible implementation, the sink transistor 180 is capable of quickly (i.e., relatively to without the sink transistor) discharging an excessive (i.e., above regulation) voltage (i.e., excessive charge) on an output capacitor (i.e., $C_O$). In another possible implementation, the sink transistor 180 is smaller than the output transistor 130. It may be advantageous to keep the size of the sink transistor as small as possible in order to conserve die area.

Figure 3:
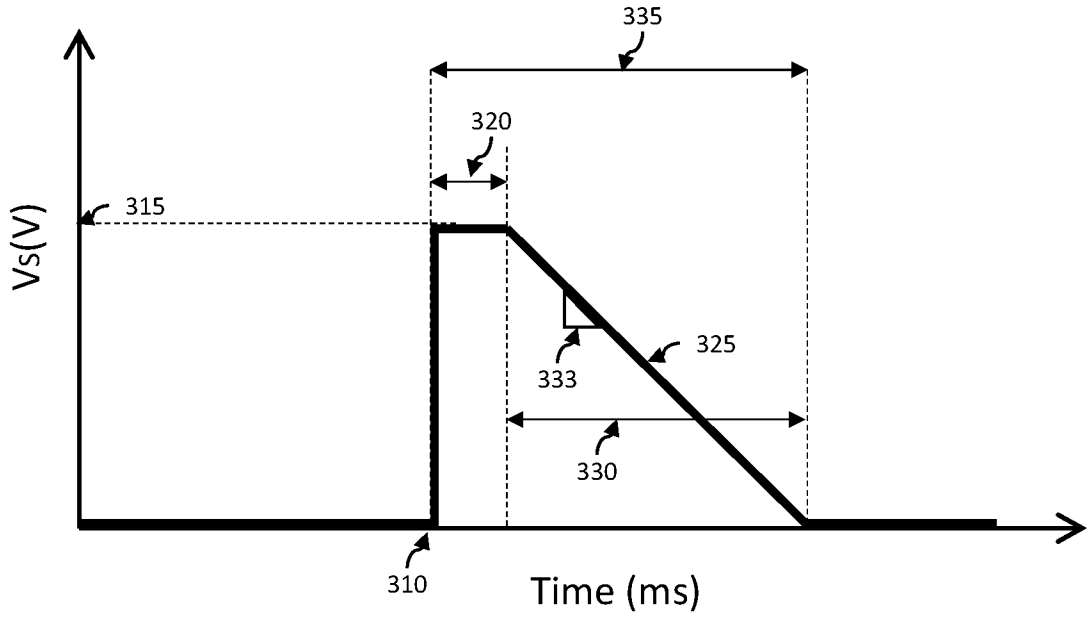
FIG. 3 is a time-based graph of a sink control signal ($V_S$) according to a possible implementation of the present disclosure.

FIG. 3 is a time-based graph of a sink control signal ($V_S$) according to a possible implementation of the present disclosure. At a time 310 at (or after) a trigger signal is received from the sink trigger 160, a sink control signal ($V_S$) rises to a ON-voltage 315 (e.g., $V_{IN}$) sufficient to cause the sink transistor 180 to conduct (i.e., turn ON). The ON-voltage 315 may be held for a ON-period 320. The ON-period 320 may be the time required to reduce the output voltage below the threshold. For example, the trigger signal provided by the sink trigger 160 may hold the sink control signal ($V_S$) at the ON-voltage 315 until the output voltage ($V_{OUT}$) drops below the reference voltage ($V_{REF}$) plus an offset voltage ($V_{OS}$).

After the ON-period 320, the sink transistor 180 may be deactivated (i.e., shut OFF, shutdown, turned OFF) according to a soft shutdown profile 325 over a shutdown period 330. The soft shutdown profile 325 may include a linear or nonlinear decrease in the level of the sink control signal according to a shutdown slope 333. For example, the sink control signal may be gradually reduced from the ON-voltage (e.g., $V_{IN}$) to a ground voltage (e.g., zero volts). During the shutdown period 330 the sink transistor 180 is gradually switched from an ON (i.e., conducting) condition to an OFF (i.e., not conducting) condition (i.e., experiences a gradual deactivation). The shutdown period 330 may be set and/or adjusted based on an expected transient response of the LDO 100 to the ON/OFF switching of the sink transistor 180. For example, the shutdown period 330 may be adjusted to minimize a load transient in the output voltage ($V_{OUT}$). A longer shutdown period may correspond to a smaller load transient than a shorter shutdown period. The triggered sink circuit is active only during an activation period 335.

Figure 4:
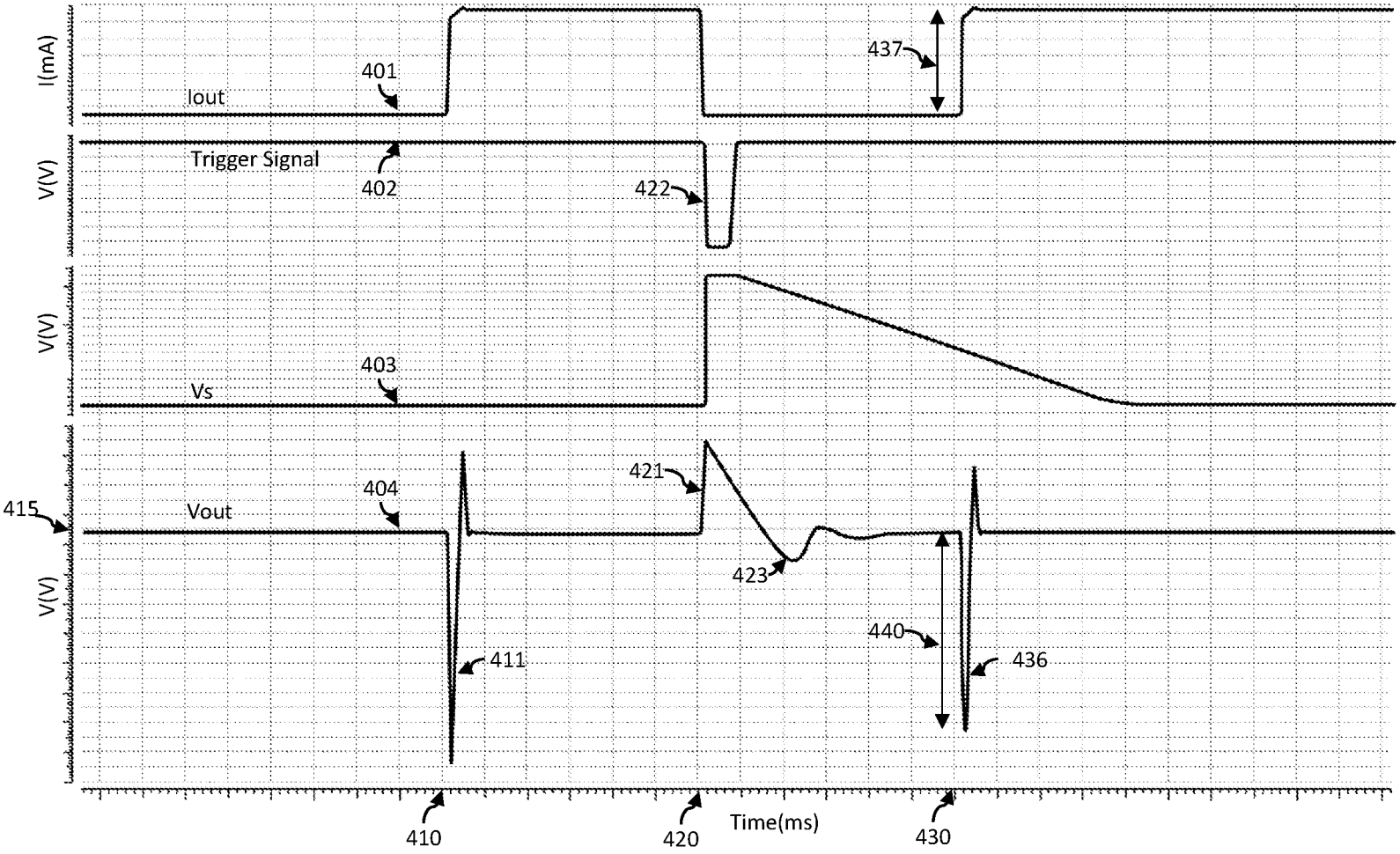
FIG. 4 includes time-based graphs illustrating an LDO's response to load transients when the triggered sink circuit is used according to a possible implementation of the present disclosure.

FIG. 4 includes time-based graphs illustrating an LDO's response to load transients when a triggered sink circuit is used. The graphs include an output current ($I_{OUT}$) graph 401, a trigger signal graph 402, a sink control signal ($V_S$) graph 403, and an output voltage ($V_{OUT}$) graph 404 and illustrates three load changes as described for TABLE 1 and FIG. 2.

A first load change at a first time 410 causes a first load transient response 411 (LOTR) that includes a decrease in output voltage ($V_{OUT}$). In response, the regulation control 110 configures the output transistor 130 to source current to the load 190 in order to restore (i.e., increase) the output voltage ($V_{OUT}$) to a regulated value 215.

The first load transient response 411 for the first load change is the same with or without (see 211 in FIG. 2) the triggered sink circuit 120 because the output voltage corresponding to the first load transient does not satisfy a condition (i.e., criterion) that activates (i.e., triggers) the triggered sink circuit 120. The conditional aspect of the triggered sink circuit 120 may advantageously facilitate a low quiescent current of the LDO because portions of the triggered sink circuit 120 are inactive until needed.

A second load change at a second time 420 causes a second load transient response 421 that includes an increase in the output voltage ($V_{OUT}$). When the output voltage changes sufficiently to satisfy a criterion (e.g., is at or above a threshold voltage), the sink trigger 160 generates a trigger signal 422. For example, the trigger signal may change to a trigger voltage that is held until the output voltage no longer satisfies the criterion (e.g., is below the threshold voltage). The trigger signal can configure the sink control 170 to generate a sink control signal ($V_S$). The sink control signal may correspond to the trigger signal. For example, the sink control signal may change to level that is held according the trigger signal. While at the held level, the sink control signal can configure the sink transistor 180 to conduct current in order to lower the output voltage. The second load transient without the trigger sink circuit (see 221 in FIG. 2) can be compared to the second load transient with the triggered sink circuit (see 421 in FIG. 2) to show that the triggered sink circuit 120 reduces the period of the second load transient.

After the output voltage is lowered, the sink control signal ($V_S$) is reduced gradually so that a load transient response 423 in the output voltage, resulting from the ON to OFF switching (i.e., deactivation) of the sink transistor is small (e.g., below a predetermined value). Because the output voltage ($V_{OUT}$) is quickly returned to a regulated voltage 415, the regulation control 110 is not forced to the limit of its control and the output transistor remains conducting (i.e., turned ON) to regulate the output voltage. In other words, the triggered sink circuit 120 can prevent loss of regulation in response to certain load transients. Accordingly, a load transient response to subsequent load change (i.e., a back-to-back load transient) can be reduced, as the output transistor 130 does not have to recover from being turned completely OFF. In other words, the sinking current from an output of the LDO using the triggered sink circuit can improve (e.g., decrease) a back-to-back load transient response below a predetermined value. The back-to-back load transient response may be defined as a first load transient response and a second load transient response separated by a period that is less than a predetermined value.

A third load change at a third time 430 causes a third load transient response 436 that includes a decrease in the output voltage ($V_{OUT}$). The third load transient response 436 with the triggered sink circuit has an amplitude 440 that is smaller than an amplitude of the third load transient response without the triggered sink circuit (see 240 in FIG. 2) because the regulation of the output has recovered from the second load change by the time the third load change occurs.

The second load transient response 421 at the second time 420 and the third load transient response 436 at the third time 430 may be referred to as back-to-back load transients because they are separated by a relatively short period (e.g., compared to a period required to restore regulation). The disclosed approach may advantageously improve a back-to-back load transient response.

The amplitude of a load transient response may correspond to an amplitude 437 of an output current change associated with a load transient. In the back-to-back load transient response, including the second load transient response 421 and the third load transient response 436, the sink transistor is partially ON at the third time 430 as it slowly deactivates (i.e., shuts OFF). In this example, the partial activation of the sink transistor 180 results in an improved LOTR 436 because the current provided by the output transistor (Mo) does not start from zero (see 236 in FIG. 2), but rather starts from a current provided by the sink transistor 180, which is partially activated.

Figure 5:
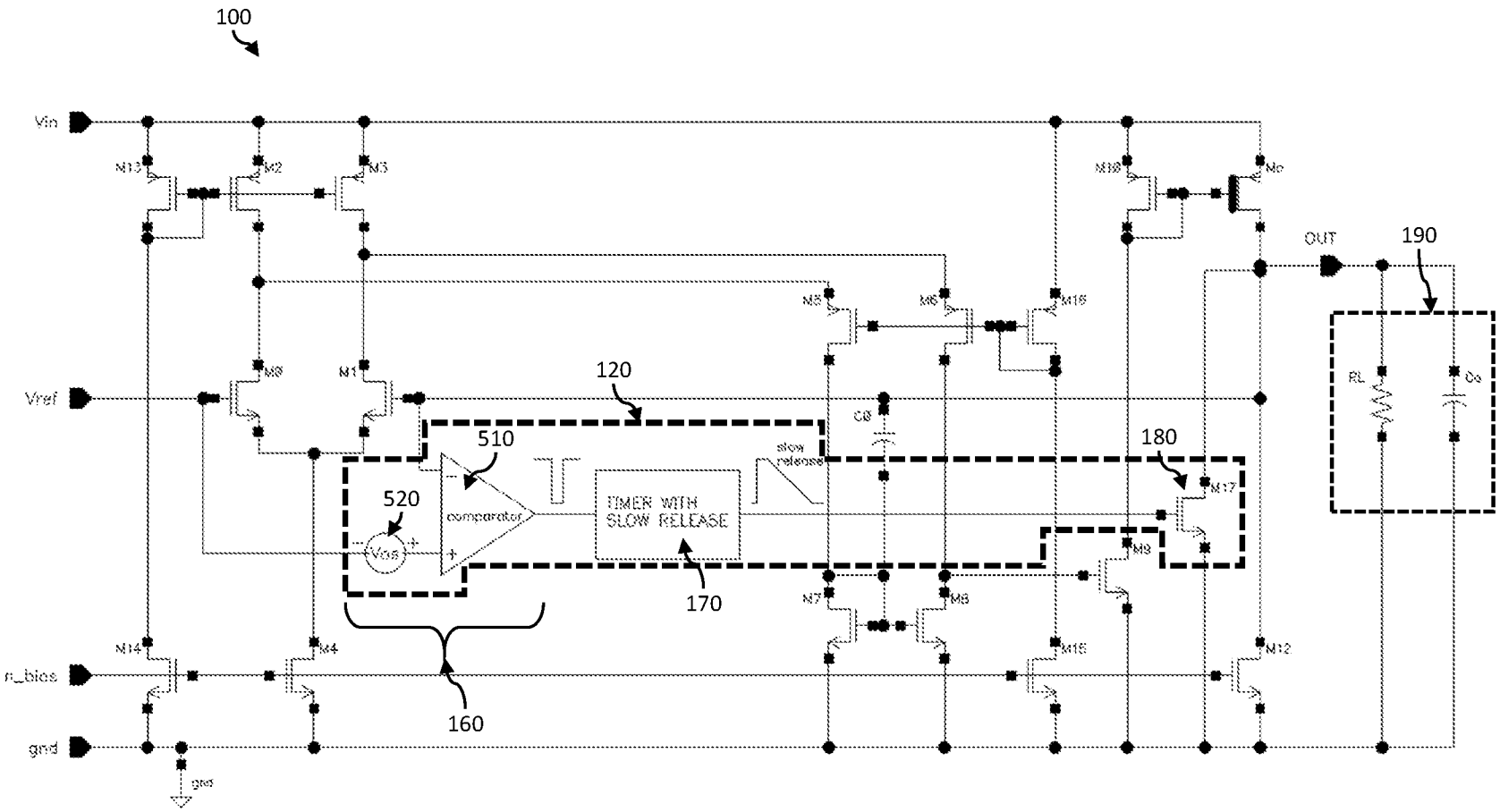
FIG. 5 is a schematic of a possible implementation of the LDO including a block diagram of a possible implementation of the triggered sink circuit.

FIG. 5 is a schematic of a possible implementation of the LDO regulator, including a block diagram of a possible implementation of the triggered sink circuit. The LDO 100 includes an output transistor ($M_O$) that is coupled to a load 190 ($R_L$, $C_O$) at an output (OUT) of the LDO. The output transistor ($M_O$) is controlled by a regulation control circuit that includes circuitry to adjust an operating point (i.e., the conduction) of the output transistor ($M_O$) according to a difference between a reference voltage ($V_{REF}$) and the output voltage ($V_{OUT}$). The difference is measured using a differential pair of transistors (M0, M1). The LDO 100 includes a leakage transistor (M12) that is sufficient to quickly sink currents comparable to a leakage current (e.g., microamps) but sized too small to quickly sink currents comparable to a load change (e.g., milliamps). Accordingly, the LDO includes a triggered sink circuit 120 to provide additional sink capability under certain load conditions.

The triggered sink circuit 120 includes a sink transistor 180 (M17) that is large enough to quickly sink currents comparable to a load change. The conduction of the sink transistor 180 is controlled by a sink control 170 (i.e., timer with slow release), which is triggered by a sink trigger 160. The sink trigger includes a comparator 510 that is configured to compare the output voltage ($V_{OUT}$) to the reference voltage ($V_{REF}$) plus an offset voltage 520 ($V_{OS}$) so that the trigger signal is generated while the output voltage meets (e.g., satisfies) the criterion that it is greater than the reference voltage ($V_{REF}$) by at least the offset voltage ($V_{OS}$).

Figure 6:
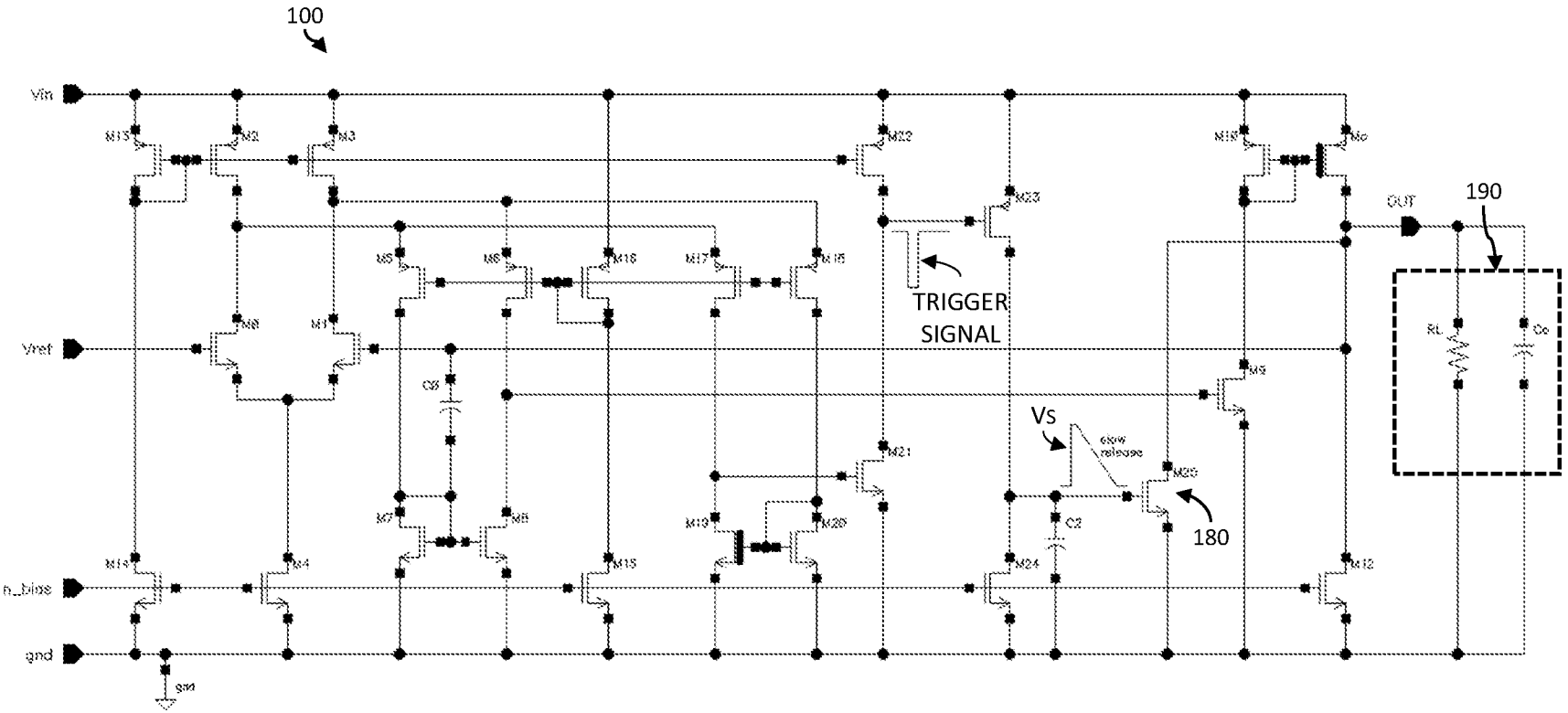
FIG. 6 is a detailed schematic of the LDO of FIG. 5 illustrating a possible circuit implementation of the triggered sink circuit.

FIG. 6 is a detailed schematic of the LDO regulator of FIG. 5 further illustrating a possible circuit implementation of the triggered sink circuit. The triggered sink circuit can share the transistors M0 and M1 of the regulation control circuit for use as a comparator (see 510 of FIG. 5). An offset voltage (see 520 of FIG. 5) can be provided by an offset comparator including a pair of transistors (M19, M20) that are mismatched in size (e.g., channel width). For example, M19 may be larger than transistor M20, as described by a size ratio. The size ratio can correspond to the offset voltage ($V_{OS}$) of the comparator, and in a possible implementation the sizes may be designed to provide an offset voltage in a range of about 10-20 millivolts (mV).

When the output voltage is higher than the reference voltage by an offset voltage (i.e., $V_{OUT} \geq V_{REF}+V_{OS}$) transistor M21 is activated (i.e., ON) to pull a controlling terminal (e.g., gate terminal) of transistor M23 to ground. In other words, M23 receives a trigger signal is created by a sink trigger 160 that includes transistors M0, M1, M19, M20 and M21.

The trigger signal pulls down the gate of transistor M23 so that transistor M23 is activated (i.e. ON), and the activation of transistor M23 charges the capacitor C2 to $V_{IN}$. When charged, the voltage ($V_{IN}$) on the capacitor C2, which is coupled to a controlling terminal (e.g., gate terminal) of the sink transistor, fully activates the sink transistor 180 M25 (i.e., the sink transistor is ON). The sink transistor 180 remains ON as long as transistors M23 and M21 remain ON.

When the output voltage drops below the reference voltage plus the offset voltage (i.e., $V_{OUT} < V_{REF}+V_{OS}$) then transistors M21 and M23 are deactivated (i.e., turned OFF). The sink transistor remains ON, however, due to the charge on the capacitor C2 and is gradually turned OFF (i.e., slowly released) as the capacitor C2 is discharged by transistor M24. In other words, the sink control 170 may include devices M23, M24, and C2.

The LDO described and shown is one possible implementation and variations may exist. Other LDO designs or topologies may advantageously use the disclosed triggered sink circuit with a slowly deactivating sink transistor to improve a load transient response (e.g., a back-to-back load transient response). Further, some circuits (i.e., stages) of the LDO been omitted for the sake of clarity and/or brevity. For example, the LDO can include other circuits/stages, such as a reference stage (e.g., to generate $V_{REF}$) and a bias stage (e.g., to generate $V_{BIAS}$).

Figure 7:
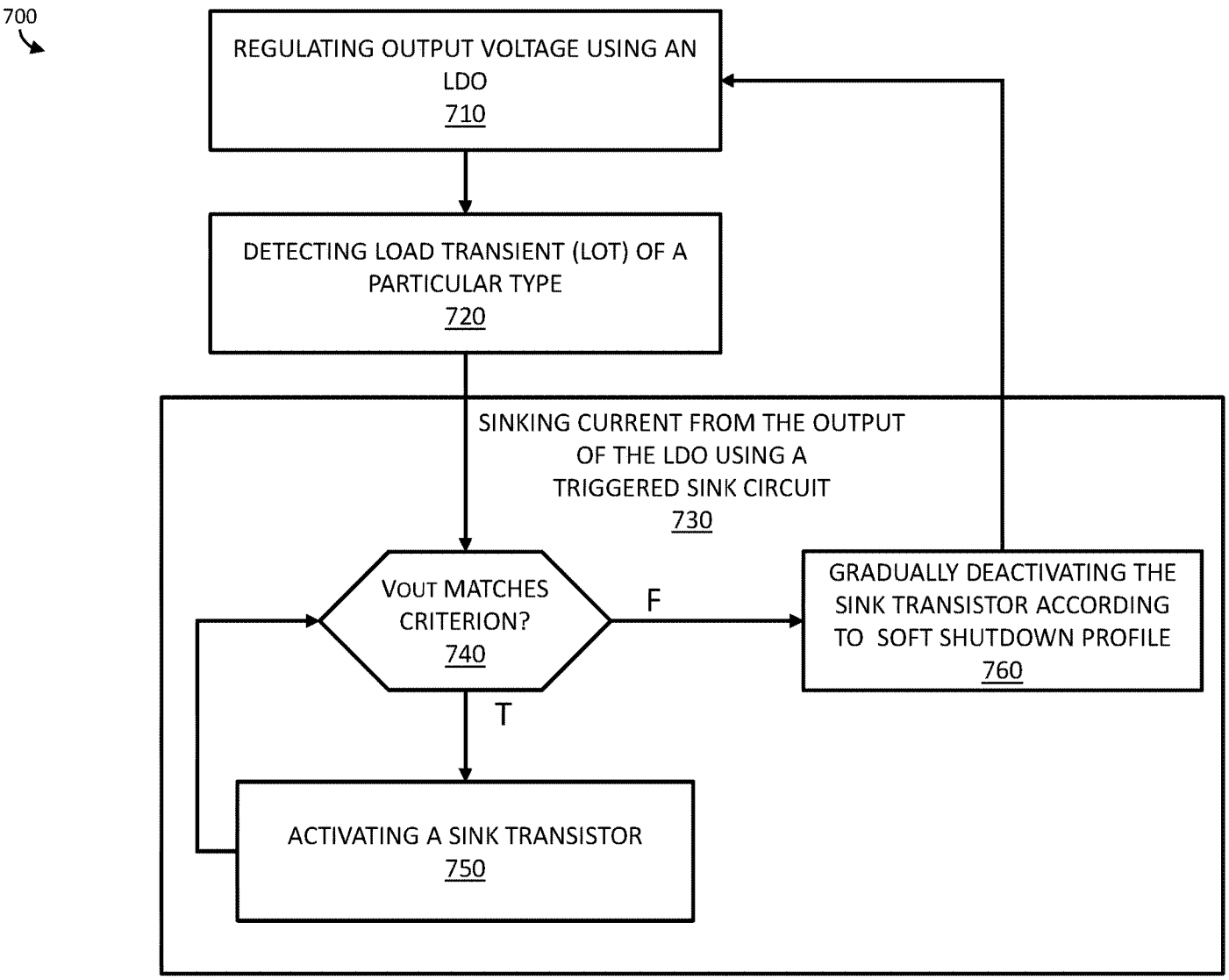
FIG. 7 is a flowchart of a method for regulating a voltage to a load that changes.

FIG. 7 illustrates a flowchart of a method for regulating an output voltage. The method 700 includes regulating 710 an output voltage using an LDO. The method further includes detecting 720 a load transient (LOT) of a particular type (see TABLE 1, LOT: SECOND TYPE). Upon detection of the LOT of the particular type, the method includes sinking current from the output 730 of the LDO using a triggered sink circuit. Sinking current from the output includes determining if the output voltage ($V_{OUT}$) meets (e.g., satisfies) a criterion 740. If the criterion is met, then a sink transistor is activated 750. The transistor remains activated to sink current from the output until the output voltage no longer meets (e.g., satisfies) the criterion. When the output voltage does not satisfy the criterion, the sink transistor is gradually deactivated 760 according to a soft shutdown profile.

In the specification and/or figures, typical embodiments have been disclosed. The present disclosure is not limited to such exemplary embodiments. For example, the low-dropout voltage regulator is one type of linear voltage regulator, but the disclosed principles may be used with other types of linear voltage regulator circuits as well. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. Ranges may be expressed herein as from "about" one particular value, and/or to "about" another particular value. When such a range is expressed, an aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

Some implementations may be implemented using various semiconductor processing and/or packaging techniques. Some implementations may be implemented using various types of semiconductor processing techniques associated with semiconductor substrates including, but not limited to, for example, Silicon (Si), Gallium Arsenide (GaAs), Gallium Nitride (GaN), Silicon Carbide (SiC) and/or so forth.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

The invention claimed is:

1. A method comprising:

regulating an output voltage using a low-dropout voltage regulator (LDO);

detecting a particular type of load transient when an output voltage of the LDO satisfies a criterion; and sinking, upon detecting the particular type of load transient, current from an output of the LDO using a triggered sink circuit including a sink transistor, wherein the sinking includes:

applying a sink control signal at an ON-voltage to the sink transistor to activate the sink transistor to sink current from the output of the LDO while the output voltage of the LDO satisfies the criterion; and when the output voltage does not satisfy the criterion, gradually changing the sink control signal applied to the sink transistor over a shutdown period to deactivate the sink transistor.

2. The method according to claim 1, wherein the particular type of load transient is a load increase and the criterion includes the output voltage of the LDO above a threshold.

3. The method according to claim 2, wherein the threshold is a reference voltage plus an offset voltage.

4. The method according to claim 1, wherein the sink control signal is:

held at an ON-voltage while the output voltage of the LDO satisfies the criterion; and reduced from the ON-voltage to zero volts according to a soft shutdown profile when the output voltage does not satisfy the criterion.

5. The method according to claim 1, wherein activating the sink transistor to sink current from the output of the LDO reduces the output voltage of the LDO, and wherein a size of the sink transistor is smaller than a size of an output transistor of the LDO.

6. A low-dropout voltage regulator (LDO), comprising:

an output transistor that is configured to increase or decrease current sourced to an output of the LDO according to a corresponding decrease or increase in an output voltage of the LDO; and a triggered sink circuit that includes a sink control configured to generate a sink control signal, the sink control signal held at an ON-voltage to activate a sink transistor to sink current from the output of the LDO when the increase in the output voltage exceeds a threshold and gradually change the sink control signal over a shutdown period to deactivate the sink transistor when the output voltage no longer exceeds the threshold.

7. The low-dropout voltage regulator (LDO) according to claim 6, wherein the decrease or increase in the output voltage is caused by a decrease or increase in a load coupled to the output of the LDO.

8. The low-dropout voltage regulator (LDO) according to claim 6, wherein the triggered sink circuit includes a sink trigger that is configured to generate a trigger signal that is held at a trigger voltage for an ON-period while the output voltage exceeds the threshold.

9. The low-dropout voltage regulator (LDO) according to claim 8, wherein the threshold is a reference voltage plus an offset voltage.

10. The low-dropout voltage regulator (LDO) according to claim 9, wherein the sink trigger includes a pair of transistors that are mismatched in size in a ratio corresponding to the offset voltage.

11. The low-dropout voltage regulator (LDO) according to claim 8, wherein the sink control is coupled between the sink trigger and a gate of the sink transistor, the sink control configured to generate a sink control signal based on the trigger signal, the sink control signal controlling the sink transistor.

12. The low-dropout voltage regulator (LDO) according to claim 11, wherein the sink control signal is at an ON-voltage for the ON-period to activate the sink transistor, and after the ON-period the sink control signal is decreased during the shutdown period according to a soft shutdown profile to deactivate the sink transistor.

13. The low-dropout voltage regulator (LDO) according to claim 12, the gradual deactivation of the sink transistor creates a load transient response that is below a predetermined value.

14. The low-dropout voltage regulator (LDO) according to claim 12, wherein the sink control includes a capacitor that is charged during the ON-period and discharged during the shutdown period.

15. The low-dropout voltage regulator (LDO) according to claim 14, wherein the capacitor is coupled to a controlling terminal of the sink transistor.

16. The low-dropout voltage regulator (LDO) according to claim 14, wherein the soft shutdown profile corresponds to a voltage of the capacitor as it is discharged.

17. The low-dropout voltage regulator (LDO) according to claim 11, wherein the output transistor is a first size and the sink transistor is a second size, the first size larger than the second size.

18. The low-dropout voltage regulator (LDO) according to claim 11, wherein the output transistor is not turned OFF while the triggered sink circuit is activated.

19. A triggered sink circuit for a linear regulator, comprising:

a sink trigger that is coupled to an output voltage of the linear regulator, the sink trigger configured to generate a trigger signal that is held at a trigger voltage during an ON-period while the output voltage of the linear regulator is above a threshold;

a sink control that receives the trigger signal and generates a sink control signal in response, wherein the sink control signal is held at an ON-voltage during the ON-period and then is reduced gradually during a shutdown period when the output voltage drops below the threshold; and a sink transistor that is activated by the ON-voltage to sink current from an output of the linear regulator during the ON-period and then is deactivated gradually during the shutdown period.

20. The triggered sink circuit for a linear regulator according to claim 19, wherein deactivating the sink transistor gradually during the shutdown period reduces a load transient response of the linear regulator resulting from ON to OFF switching of the sink transistor.

* * * * *